United States Patent [19]

Southwick et al.

[11] Patent Number: 4,470,421

[45] Date of Patent: Sep. 11, 1984

[54] SMOKING COMPOSITIONS

[75] Inventors: Everett W. Southwick, Richmond; Harvey J. Grubbs, Mechanicsville, both of Va.

[73] Assignee: Philip Morris, Incorporated, New York, N.Y.

[21] Appl. No.: 373,901

[22] Filed: May 3, 1982

[51] Int. Cl.[3] ..... A24B 3/12; C08F 18/24; C07C 69/96

[52] U.S. Cl. ..... 131/276; 560/190

[58] Field of Search ..... 131/275, 276; 260/77.5 UA, 78.3 UA; 426/538, 534; 560/190

[56] References Cited

U.S. PATENT DOCUMENTS

| | | | |
|---|---|---|---|
| 3,782,391 | 1/1974 | Means et al. | 131/17 R |
| 3,854,485 | 12/1974 | Mold et al. | 131/17 R |
| 4,036,237 | 7/1977 | Teng | 131/17 R |
| 4,119,106 | 10/1978 | Grubbs et al. | 131/276 |
| 4,171,702 | 10/1979 | Grubbs | 131/276 |

*Primary Examiner*—V. Millin
*Assistant Examiner*—G. Beaucage
*Attorney, Agent, or Firm*—Arthur I. Palmer; George E. Inskeep; James E. Schardt

[57] ABSTRACT

In one of its embodiments this invention provides a smoking composition which contains a novel type of flavorant additive as exemplified by polymerized ethyl 2-propenyl 2-(2-butyl)malonate:

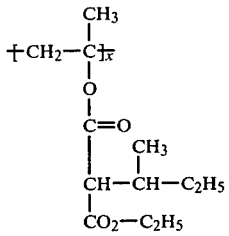

13 Claims, No Drawings

SMOKING COMPOSITIONS

BACKGROUND OF THE INVENTION

The incorporation of flavorants in tobacco products is an important development in the tobacco industry due to the lowered aromaticity of the available tobacco and the increased preference of smokers for filter cigarettes and low delivery cigarettes.

The use of carboxylic acid and ester flavorants for tobacco products has received acceptance because of the desirable aroma and flavor characteristics which they impart to the smoke (J. C. Leffingwell, H. J. Young, and E. Bernasek, "Tobacco Flavoring for Smoking Products", R. J. Reynolds Tobacco Company, Winston-Salem, 1972). Specifically, acetic acid is commonly used as an ingredient of a Latakia tobacco flavoring formulation (J. Merory, "Food Flavorings", AVI Publishing Company, Incorporated, Westport, Conn., page 420, 1968). Isovaleric acid and 3-methylvaleric acid are major ingredients in a Turkish tobacco flavor formulation (R. H. Stedman and C. D. Stills, U.S. Pat. No. 3,180,340). Desirable flavors have been imparted to cigarette smoke by the addition of 4-ketoacids to tobacco (W. A. Rohde, U.S. Pat. No. 3,313,307).

Numerous methods of adding flavorants to tobacco smoke are known. However, none of the known methods has been found to be completely satisfactory, particularly when the flavorant is a low molecular weight carboxylic acid or ester. Specifically, some of these acids and esters are highly volatile and possess objectionably strong odors that render them difficult to use in bulk amounts required for manufacturing purposes. In addition, some of the volatile acids and esters may impart an undesirable pack aroma.

In an attempt to alleviate some of these problems, carboxylic acids have been incorporated in tobacco as part of a compound (i.e., an organic acid release agent) in such form that upon burning of the tobacco the compound will liberate one or more organic acids imparting a selected and desired flavor and aroma to the smoke. While considerably more satisfactory than earlier attempts, even this technique has evidenced certain drawbacks.

U.S. Pat. No. 2,766,145 through U.S. Pat. No. 2,766,150 describe a variety of methods for treating tobacco with compounds that release carboxylic acids on pyrolysis. The U.S. Pat. No. 2,766,145 patent describes esters of monohydric and polyhydric compounds. The hydroxy compounds may be aliphatic or aromatic in nature.

The U.S. Pat. No. 2,766,146 patent describes esters of a sugar acid selected from aldonic acids and uronic acids. U.S. Pat. No. 2,766,150 describes nonvolatile synthetic polymers or condensation products, preferably those related to polyvinyl alcohol and vinyl alcohol-type condensation products. On pyrolysis, the carboxylic acid is liberated to flavor the smoke. These polymers have a distinct disadvantage in that they generally have high molecular weights and are difficult to solubilize for application on tobacco.

Other references which disclose tobacco flavorant compositions that release carboxylic acids on pyrolysis include U.S. Pat. Nos. 4,036,237 and 4,171,702.

In a similar manner, the incorporation in tobacco of flavorants in the form of clathrates has been tried and found to be unsatisfactory, since the yield of flavor when tobacco containing such clathrates is burned is very low.

Further, as described in U.S. Pat. No. 3,782,391 alkyl esters of beta-methyl valeric acid are known to impart a fruity, apple-like aroma and a nut-like flavor when incorporated in tobacco. However, as noted in U.S. Pat. No. 3,854,485, such flavorant compounds are relatively volatile substances with a low odor threshold, and they present an evaporation problem in prolonged storage of the flavored tobacco compositions. Other esters such as monoesters of monoalkyl and dialkyl malonates are known to provide a tobacco smoke with a fermented apple-peel and walnut-like flavor and aroma, but such esters yield only a limited degree of flavor enhancement in tobacco products.

There remains a need for smoking compositions with enhanced flavor and aroma that do not exhibit the various disadvantages of prior art smoking compositions which contain a relatively volatile compound as a flavorant additive.

Accordingly, it is a main object of this invention to provide tobacco and non-tobacco smoking compositions which have incorporated therein a flavorant additive which is characterized by low volatility and low pack aroma.

It is another object of this invention to provide smoking compositions of tobacco and non-tobacco materials containing a polymerizable or polymerized malonate ester flavorant additive, which smoking compositions are adapted to impart flavor and aroma to the mainstream and sidestream smoke under smoking conditions.

It is a further object of this invention to provide polymerizable and polymerized malonate diesters which are suitable as flavorant additives for smoking compositions, which when subjected to pyrolysis conditions release monoesters and other volatile constituents which enhance the flavor and aroma of smoking compositions.

Other objects and advantages of the present invention shall become apparent from the accompanying description and examples.

DESCRIPTION OF THE INVENTION

One or more objects of the present invention are accomplished by the provision of a smoking composition comprising an admixture of (1) combustible filler selected from natural tobacco, reconstituted tobacco, non-tobacco substitutes, and mixtures thereof, and (2) between about 0.00001 and 2 weight percent, based on the total weight of filler, of a malonate diester corresponding to the formula:

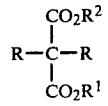

where R is a substituent selected from hydrogen and alkyl groups containing between about 1–12 carbon atoms, and at least one R is an alkyl group; $R_1$ is a substituent selected from saturated aliphatic, saturated alicyclic and aromatic groups containing between about 1–20 carbon atoms; and $R^2$ is a polymerizable substituent selected from olefinically unsaturated aliphatic and cycloaliphatic groups containing between about 2–20 carbon atoms; and wherein the molecular weight of the malonate diester is at least about 200.

Illustrative of the R substituents in the represented malonate diester formula are groups which include methyl, ethyl, butyl, heptyl, 2-ethylhexyl, decyl, dodecyl, and the like.

Illustrative of the $R^1$ substituent in the represented malonate diester formula are groups which include methyl, ethyl, propyl, butyl, pentyl, hexyl, methoxyethyl, ethoxyethyl, cyclopropyl, cyclobutyl, cyclopentyl, cyclohexyl, menthyl, furyl, tetrahydrofuryl, piperidyl, pyrrolidyl, pyrazolyl, phenyl, tolyl, xylyl, benzyl, phenylethyl, methoxyphenyl, naphthyl, pyridyl, pyridazyl, pyrimidyl, pyrazyl, and the like.

Illustrative of the $R^2$ substituent in the represented malonate diester formula are groups which include vinyl, allyl, methallyl, isopropenyl, 2-butenyl, 4-methoxy-2-butenyl, 2,4-hexadienyl, 5-cyclohexyl-3-hexenyl, 3-ethyl-2-octenyl, 2-cyclohexenyl, and the like.

In one of its important embodiments, the present invention provides a polymerized malonate diester corresponding to the formula:

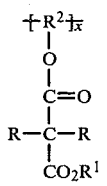

where R, $R^1$ and $R^2$ are as previously defined, with the proviso that $R^2$ is the corresponding polymerized olefinic radical; and X is an integer which is 2 or greater. The molecular weight of the polymerized malonate diester is at least about 400, and the average molecular weight will vary in the range between about 1000–10,000.

In a particularly preferred embodiment of the present invention, the polymerized malonate diester formula above has one R substituent which is hydrogen and one R substituent which is 2-butyl, and the $R^1$ substituent is ethyl. Under pyrolysis conditions, the said preferred type of polymerized malonate diester yields monoester derivatives such as ethyl 3-methylpentanoate. When the polymerized malonate diester is employed as a flavorant in a smoking composition, pyrolysis products comprising ethyl 3-methylpentanoate are formed and volatilized under smoking conditions to provide unique enhancement of the flavor and aroma of mainstream and sidestream smoke.

Preparation Of Malonate Diesters And Polymerized Forms Thereof

In one method of preparation, a malonyl halide derivative is condensed with a suitable olefinically unsaturated aliphatic or cycloaliphatic alcoholate:

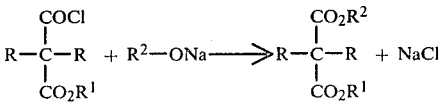

In another method of preparation, ester exchange is achieved in the presence of a catalyst such as a palladium(II) compound:

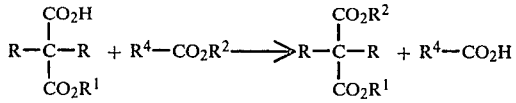

where $R^4$ preferably is a lower alkyl radical.

U.S. Pat. No. 2,756,219 describes a general method for the production of polymerizable esters which are olefinically unsaturated in not more than one ester group. In the case of a diester, a dicarboxylic acid such as malonic acid or terephthalic acid is reacted sequentially with a saturated alcohol and an unsaturated alcohol to yield a mixture of diester derivatives.

U.S. Pat. No. 2,993,860 describes a method for producing unsymmetrical unsaturated esters by esterification of a dicarboxylic acid with a mixture of alcohols under acidic conditions. For example, two moles of sebacic acid is reacted with one mole of allyl alcohol and 3 moles of 3,5,5-trimethylhexanol in benzene under reflux in the presence of sulfuric acid.

Other methods of polyester synthesis are disclosed in U.S. Pat. Nos. 3,843,719 and 4,112,235.

The polymerized forms of the invention malonate diester compounds are readily obtained by means of conventional free radical types of polymerization systems, e.g., by heating the polymerizable malonate diester in the presence of a peroxide compound or other free radical initiator. Methods of polymerizing olefinically unsaturated esters are described in U.S. Pat. Nos. 2,756,219 and 2,993,860.

PREPARATION OF TOBACCO COMPOSITIONS

The present invention smoking compositions can be prepared by admixing natural tobacco and/or reconstituted tobacco and/or a non-tobacco substitute with between about 0.00001 and 2 weight percent, and preferably 0.0001–2 weight percent, based on the weight of the smoking composition, of a flavorant additive which corresponds to one of the structural formulae set forth hereinabove in definition of the polymerizable and polymerized malonate diester compounds.

An invention malonate diester flavorant additive can be incorporated into the tobacco in accordance with methods known and used in the art. Preferably the flavorant additive is dissolved in a solvent such as water, alcohol, or mixtures thereof, and then sprayed or injected into the tobacco or non-tobacco substitute matrix. Such method ensures an even distribution of the flavorant additive throughout the tobacco, and thereby facilitates the production of a more uniform smoking composition. Alternatively, the flavorant may be incorporated as part of a concentrated tobacco extract which is applied to a fibrous tobacco web as in the manufacture of reconstituted tobacco. Another suitable procedure is to incorporate the flavorant in tobacco or non-tobacco substitute filler in a concentration between about 0.5–5 weight percent, based on the weight of filler, and then subsequently to blend the treated filler with filler which does not contain flavorant additive.

The term "non-tobacco substitute" is meant to include smoking filler materials such as are disclosed in U.S. Pat. Nos. 3,529,602; 3,703,177; 3,796,222; 4,019,521; 4,079,742; and references cited therein; incorporated herein by reference.

Illustratively, U.S. Pat. No. 3,529,602 describes a burnable sheet which may be used as a tobacco substitute, which sheet contains ingredients which include (1) a film-forming ingredient comprising a pectinaceous material derived from tobacco plant parts and having an acid value in excess of 30 milligrams of potassium hydroxide per gram, and (2) a mineral ingredient comprising an alkali metal salt, an alkaline earth metal salt or clay.

U.S. Pat. No. 3,703,177 describes a process for preparing a non-tobacco smoking product from sugar beet pulp, which process involves the acid hydrolysis of the beet pulp to release beet pectins, and at least an alkaline earth treatment thereafter to cause crosslinking of the pectins and the formation of a binding agent for the exhausted beet matrix.

U.S. Pat. No. 3,796,222 describes a smoking product derived from coffee bean hulls. The hulls are treated with reagents that attack the alkaline earth metal crosslinks causing the release of the coffee pectins. The pectins act as a binding agent and together with the treated hulls may be handled and used similarly to a tobacco product.

U.S. Pat. No. 4,019,521 discloses a process for forming a smoking material which involves heating a cellulosic or carbohydrate material at a temperature of 150°–750° C. in an inert atmosphere for a period of time sufficient to effect a weight loss of at least 60 percent but not more than 90 percent.

U.S. Pat. No. 4,079,742 discloses a process for the manufacture of a synthetic smoking product from a cellulosic material, which process involves a pyrolysis step and a basic extraction step to yield a resultant matrix which has a tobacco-like brown color and has improved smoking characteristics.

When a present invention polymerized malonate diester is incorporated into smoking material as a flavorant additive, and cigarettes are manufactured from the flavored blend, under smoking conditions the cigarettes have a distinct sweet fruity note and increased flavor amplitude in comparison with control cigarettes which do not contain the invention malonate diester flavorant additive.

The following examples are further illustrative of the present invention. The reactants and other specific ingredients are presented as being typical, and various modifications can be derived in view of the foregoing disclosure within the scope of the invention.

EXAMPLE I

Preparation Of Ethyl 2-(2-Butyl)malonyl Chloride

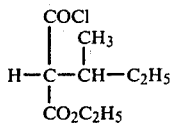

To dry ethyl ether (55.0 ml) under nitrogen was added ethyl 2-(2-butyl)malonic acid (55.0 g, 0.29 mole). Thionyl chloride (32.0 ml, 52.5 g, 0.44 mole) was added dropwise with stirring. The solution was heated to 50° C. for 2 hours under nitrogen, at which time no further HCl was evolved.

The mixture was allowed to cool to room temperature with stirring, and after stirring at room temperature for 60 hours the mixture was subjected to reduced pressure distillation. The remaining liquid was fractionated yielding a heart cut of 26.2 g (43.7%), b.p. 58°–61° C. at 0.05 mm.

The structure of the compound was confirmed by IR and NMR spectral analysis.

EXAMPLE II

Preparation Of Ethyl 2-Methyl-3-butene-2-yl 2-(2-Butyl)malonate

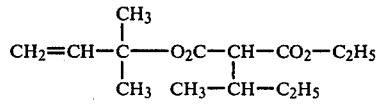

To a solution of 2-methyl-3-buten-2-ol (4.1 g, 0.048 mole) in dry ether (10 ml) stirred under dry nitrogen at 5° C. was added a solution of n-butyllithium (19.3 ml, 0.048 mole, 2.5M in hexane). After completion of the addition, ethyl 2-(2-butyl)malonyl chloride (10.0 g, 0.048 mole) was added slowly with stirring, and an additional 10 ml quantity of ether was added. The suspension was stirred for 2 hours with warming to room temperature. The resultant suspension was extracted with water, a saturated ammonium chloride solution, and then water again. The layers were separated and the organic layer dried over magnesium sulphate, filtered, and subjected to reduced pressure distillation. The pale yellow liquid obtained was subjected to fractional distillation. A heart cut of 8.0 g (64.5%), b.p. 69°–71° C. at 0.1 mm, was obtained.

The structure of the compound was comfirmed by IR and NMR spectral analysis, and by elemental analysis.

EXAMPLE III

Preparation Of Ethyl 3,7,11-Trimethyl-1,6,10-dodecatriene-3-yl 2-(2-Butyl)malonate

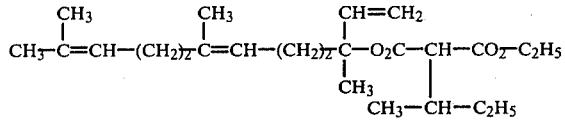

To a solution of nerolidol (5.3 g, 0.024 mole) in 20 ml of dry ether, n-butyllithium (9.6 ml, 0.024 mole, 2.5M in hexane) was added with stirring under a blanket of dry nitrogen. The reaction mixture was cooled by means of a dry ice-acetone bath. Upon completion of addition, ethyl 2-(2-butyl)malonyl chloride (5.0 g, 0.024 mole) was added slowly. After addition was completed, the mixture was allowed to warm to room temperature with stirring for a period of 4 hours.

The solution was then extracted with water followed by saturated ammonium chloride until a pH of 7 was obtained. The layers were separated and the ether solution was dried over magnesium sulphate, filtered, and subjected to reduced pressure distillation. The residue obtained was distilled on a Kugelrohr apparatus to yield 7.07 g of product, b.p. 129°–132° C. (air temperature) at 0.4 mm. Preparative TLC of the distillate yielded 5.30 g (56.3%) of pure product.

The structure of the compound was confirmed by IR and NMR spectral analysis, and by elemental analysis.

EXAMPLE IV

Preparation Of Ethyl 2-Propenyl 2-(2-Butyl)malonate

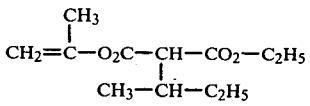

A suspension of 0.11 g $PdCl_2$, 0.5 g glacial acetic acid and 0.5 ml saturated aqueous NaCl solution was gently warmed to effect solution, then neutralized with 10% NaOH and dried under vacuum. The dried solid was admixed at room temperature with a solution of 7 g of ethyl 2-(2-butyl)malonate in 20 g of 2-propenyl acetate.

After stirring 16 hours, the resulting suspension was filtered through Celite® and the solids washed with ether. The filtrate was washed with saturated sodium bicarbonate solution, dried over magnesium sulfate and concentrated under reduced pressure. The residue was distilled to give 2.35 g of colorless liquid, b.p. 55° (0.07 mm). Spectroscopic and elemental analysis confirmed the structure of the compound.

EXAMPLE V

Preparation Of Ethyl Vinyl 2-(2-Butyl)malonate

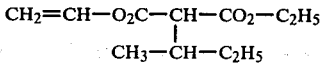

To a solution of ethyl 2-(2-butyl)malonic acid (9.4 g, 0.05 mole) in 100 ml of dry tetrahydrofuran was added sodium hydride dispersion (2.4 g, 0.05 mole, 50% in oil) at such a rate that the temperature did not exceed 25° C. An additional 100 ml of dry tetrahydrofuran was added, and then vinyl chloroformate (6.39, 0.06 mole) in 75 ml of dry tetrahydrofuran was added slowly. After addition was completed the reaction was allowed to warm to room temperature with stirring. Gas evolution was observed, and the mixture was heated to 35° C. with stirring for 1 hour.

The mixture was cooled to room temperature, and then added to 150 ml ether. The ether solution was extracted with three portions of water, separated and dried over magnesium sulphate. After filtration, the solvent was removed under reduced pressure to yield a light red oil. Fractional distillation provided a heart cut of 2.4 g (22.4%). b.p. 65°–68° C. at 0.05 mm. Spectroscopic analysis confirmed the structure of the compound.

EXAMPLE VI

Preparation Of Poly[2-propenyl ethyl 2-(2-butyl)malonate]

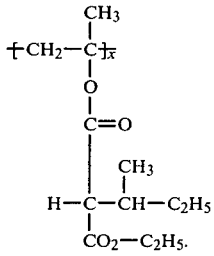

A sample of freshly distilled 2-propenyl ethyl 2-(2-butyl)malonate (13.45 g) was blanketed under a dry nitrogen atmosphere. Dibenzoyl peroxide (0.67 g, 5% wt/wt) was added and the suspension stirred with heating to 80° C. The polymerization was conducted at 80° C. for 48 hours.

On cooling to room temperature, a yellow viscous oil was obtained. The oil was subjected to fractionation by preparative gel permeation chromatography. The fractionation results were as follows:

| Fraction Number | Fraction Weight (g) | Appearance | Molecular Weight |
|---|---|---|---|
| 1 | 0.92 | yellow solid | 1233 |
| 2 | 3.64 | opaque white solid | 892 |
| 3 | 4.56 | viscous yellow syrup | 850 |
| 4 | 4.93 | yellow liquid | 289 |
| 5 | 1.15 | white liquid | 224 |
| 6 | 0.90 | white liquid | 176 |

Analysis calculated for $(C_{12}H_{20}O_4)x$ C, 63.12; H, 8.85 x=1, molecular wt=228.32.

Yield of polymer (fractions 1, 2, and 3)=9.12 g, 67.8%.

The molecular weight data were obtained by vapor phase osmometry.

EXAMPLE VII

Preparation Of Poly[3-methyl-1-buten-3-yl ethyl 2-(2-butyl)malonate]

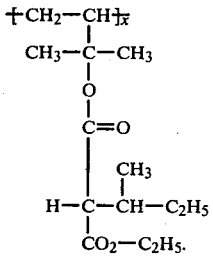

A sample of freshly distilled 3-methyl-1-buten-3-yl ethyl 2-(2-butyl)malonate was polymerized employing the conditions described in Example VI. The resultant viscous light yellow liquid was subjected to fractionation by preparative gel permeation chromatography, and three main fractions were obtained:

| Fraction Number | Fraction Weight (g) | Molecular Weight |
|---|---|---|
| 1 | 1.05 | 1264 |
| 2 | 0.72 | 582 |
| 3 | 2.78 | monomer |

A yield of 1.77 g (21%) of polymer product was obtained from the polymerization procedure. The molecular weight data were obtained by vapor phase osmometry.

EXAMPLE VIII

This Example illustrates the preparation of a present invention smoking composition.

Cigarettes were fabricated employing a blend of tobaccos treated with an ethanolic solution of poly[2-propenyl ethyl 2-(2-butyl)malonate] to provide a tobacco blend with a concentration of flavorant of 23 ppm. The cigarettes were targeted to deliver 8 mg of tar per cigarette. Untreated controls were prepared and the treated cigarettes were compared to the controls by an experienced smoking panel. The treated cigarettes were found to have a distinct sweet and fruity note and more response as compared to the controls.

What is claimed is:

1. A smoking composition comprising an admixture of (1) combustible filler selected from natural tobacco, reconstituted tobacco, non-tobacco substitutes, and mixtures thereof, and (2) between about 0.00001 and 2 weight percent, based on the total weight of filler, of a malonate diester corresponding to the formula:

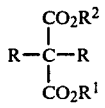

where R is a substituent selected from hydrogen and alkyl groups containing between about 1–12 carbon atoms, and at least one R is an alkyl group; $R^1$ is a substituent selected from saturated aliphatic, saturated alicyclic and aromatic groups containing between about 1–20 carbon atoms; and $R^2$ is a polymerizable substituent selected from olefinically unsaturated aliphatic and cycloaliphatic groups containing between about 2–20 carbon atoms; and wherein the molecular weight of the malonate diester is at least about 200.

2. A smoking composition in accordance with claim 1 wherein the non-tobacco substitutes are selected from pectinaceous, cellulosic and carbohydrate materials.

3. A smoking composition in accordance with claim 1 wherein the malonate diester is in a polymerized form having a molecular weight of at least about 400.

4. A smoking composition in accordance with claim 1 wherein the malonate diester is ethyl 2-methyl-3-butene-2-yl 2-(2-butyl)malonate.

5. A smoking composition in accordance with claim 4 wherein the ethyl 2-methyl-3-butene-2-yl 2-(2-butyl)malonate is in a polymerized form.

6. A smoking composition in accordance with claim 1 wherein the malonate diester is ethyl 3,7,11-trimethyl-1,6,10-dodecatriene-3-yl 2-(2-butyl)malonate.

7. A smoking composition in accordance with claim 6 wherein the ethyl 3,7,11-trimethyl-1,6,10-dodecatriene-3-yl 2-(2-butyl)malonate is in a polymerized form.

8. A smoking composition in accordance with claim 1 wherein the malonate diester is ethyl 2-propenyl 2-(2-butyl)malonate.

9. A smoking composition in accordance with claim 8 wherein the ethyl 2-propenyl 2-(2-butyl)malonate is in a polymerized form.

10. A smoking composition in accordance with claim 1 wherein the malonate diester is ethyl vinyl 2-(2-butyl)-malonate.

11. A smoking composition in accordance with claim 10 wherein the ethyl vinyl 2-(2-butyl)malonate is in a polymerized form.

12. A method of preparing a smoking composition which is adapted to impart flavoring to the mainstream and sidestream smoke under smoking conditions, which method comprises incorporating into natural tobacco, reconstituted tobacco, non-tobacco substitute or mixtures thereof between about 0.00001 and 2 weight percent, based on composition weight, of malonate diester flavorant additive corresponding to the formula:

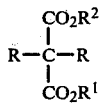

where R is a substituent selected from hydrogen and alkyl groups containing between about 1–12 carbon atoms, and at least one R is an alkyl group; $R^1$ is a substituent selected from saturated aliphatic, saturated alicyclic and aromatic groups containing between about 1–20 carbon atoms; and $R^2$ is a polymerizable substituent selected from olefinically unsaturated aliphatic and cycloaliphatic groups containing between about 2–20 carbon atoms; and wherein the molecular weight of the malonate diester is at least about 200.

13. A method of preparing a smoking composition in accordance with claim 11 wherein the malonate diester flavorant additive is in a polymerized form having a molecular weight of at least about 400.

* * * * *